US006195926B1

(12) United States Patent
Jarl et al.

(10) Patent No.: US 6,195,926 B1
(45) Date of Patent: Mar. 6, 2001

(54) JARDIN GEM, A SET OF IDENTIFIER STRATAGEMS, WITH ACCESSORIES

(76) Inventors: Corinne L. Jarl, Five Mulford La., Belle Mead, NJ (US) 08502; John M. Tursky, 13 Banor Dr., Somerville, NJ (US) 08876

( * ) Notice: Subject to any disclaimer, the term of this patent is extended or adjusted under 35 U.S.C. 154(b) by 0 days.

(21) Appl. No.: 08/917,627

(22) Filed: Aug. 22, 1997

(51) Int. Cl.[7] ..... G09F 23/00

(52) U.S. Cl. ..... 40/645; 40/659; 47/44; 248/87

(58) Field of Search ..... 24/67.9, 547; 40/637, 40/645, 659, 744; 47/33, 44, 46, 47, 66.6; 248/87, 156, 27.8, 80, 85; 239/273, 275, 276, 279, 280

(56) References Cited

U.S. PATENT DOCUMENTS

| | | | | |
|---|---|---|---|---|
| 484,902 | * | 10/1892 | SXmith | 40/659 |
| 509,187 | * | 11/1893 | Unkefer | 248/85 |
| 517,545 | * | 4/1894 | Duckett | 40/659 |
| 551,000 | * | 12/1895 | Parker | 40/645 X |
| 828,542 | * | 8/1906 | Ellis | 40/659 X |
| 879,493 | * | 2/1908 | Robinson | 40/659 |
| 1,534,438 | * | 4/1925 | Abby | 248/87 |
| 1,590,722 | * | 6/1926 | Brakmeier | 40/645 |
| 1,616,147 | * | 2/1927 | Smiley | 40/645 |
| 1,863,608 | * | 6/1932 | Stewart | 40/645 |
| 2,013,447 | * | 9/1935 | Reiter | 248/87 |
| 2,173,217 | * | 9/1939 | Thomsen | 47/47 |
| 2,229,527 | * | 1/1941 | Schouman | 47/47 |
| 2,331,421 | * | 10/1943 | Redhead | 239/275 |
| 2,349,505 | * | 5/1944 | Lohne | 248/85 |
| 2,520,818 | * | 8/1950 | Terry | 248/153 |
| 2,536,341 | * | 1/1951 | Asher | 248/87 |
| 2,574,441 | * | 11/1951 | Stewart | 248/87 |
| 2,619,770 | * | 12/1952 | Dinhofer | 446/72 |
| 2,650,454 | * | 9/1953 | Wurdinger | 47/44 |
| 2,657,096 | * | 10/1953 | Holmes | 239/276 |
| 2,720,371 | * | 10/1955 | Campbell | 248/85 |
| 2,747,823 | * | 5/1956 | Swenholt | 248/85 |
| 3,239,174 | * | 3/1966 | Churchman | 248/87 |
| 3,301,515 | * | 1/1967 | Gerbracht | 248/87 |
| 3,679,312 | * | 7/1972 | Mansberg | 436/172 |
| 4,569,413 | * | 2/1986 | Allen | 181/131 |
| 5,088,666 | * | 2/1992 | Lang | 248/87 |
| 5,138,851 | * | 8/1992 | Mardikian | 62/244 |
| 5,427,315 | * | 6/1995 | Lipson | 239/33 |

FOREIGN PATENT DOCUMENTS

| | | | | |
|---|---|---|---|---|
| 43824 | * | 3/1931 | (DK) | 47/47 |
| 933282 | * | 8/1963 | (GB) | 47/47 |

* cited by examiner

*Primary Examiner*—Terry Lee Melius
*Assistant Examiner*—Andrea Chop

(57) ABSTRACT

Jardin Gem is a set of three multipurpose, independent identifier stratagems. Jardin Gem Topper is the primary device and is a hose support/hose guard/holder/identifier with a variety of configurated tops through which each top a hose can be laced or something attached. Every top also serves as a push-pull handle to put its opposite end into soil, predrilled wood, a cored brick, or whatever. The secondary identifier is the Jardin Gem Straww used as a marker while in the ground before, during, and after plant growth. If a Topper is slid into a Straww, the latter functions as an auxiliary identifier or when a watering, soaker, or sprinkler hose needs to be laced through a series of tops. The third device is the Jardin Gem Barr . . . a single Jardin Gem Straww nested in between two elbow connectors . . . which can be easily positioned horizontally or vertically. Each identifier may be imprinted or used with one of the three companion accessories: Jardin Gem Beadd—to spell a label; Jardin Gem Bracelett—a ball chain; Jardin Gem Tagg—a metal tag. The Tagg hangs from a Topper/Barr/Bracelett; the Beadds slip onto a Barr/Bracelett; and the Bracelett can hang from a Topper/Barr. These custom-formed devices are simplistic in design; strong but light in weight; easily movable; comfortable to touch; attractive; impervious to weather elements/lawn chemicals; never deteriorate; durable until recycled; and safe for the environment.

1 Claim, 6 Drawing Sheets

FIG. 1 SELECTION OF CONFIGURED JARDIN GEM TOPPERS

JARDIN GEM TOPPER ELEVATED

GARDEN HOSE AT GROUND LEVEL

JARDIN GEM TOPPER AS AN IDENTIFIER W/ PLACARD
BACK VIEW

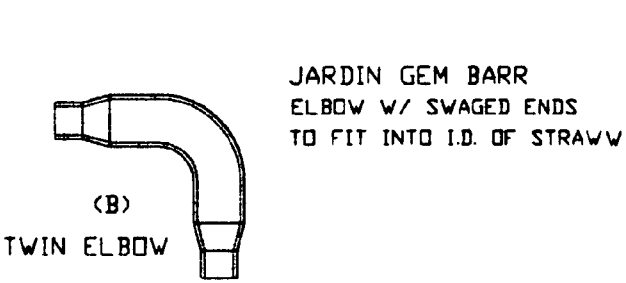
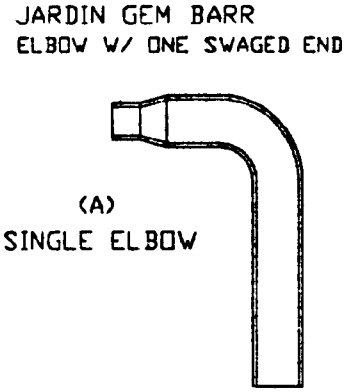
FIG. 6
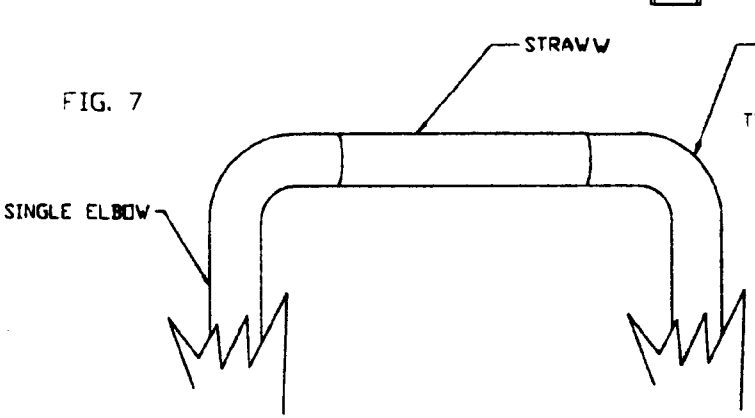
FIG. 7
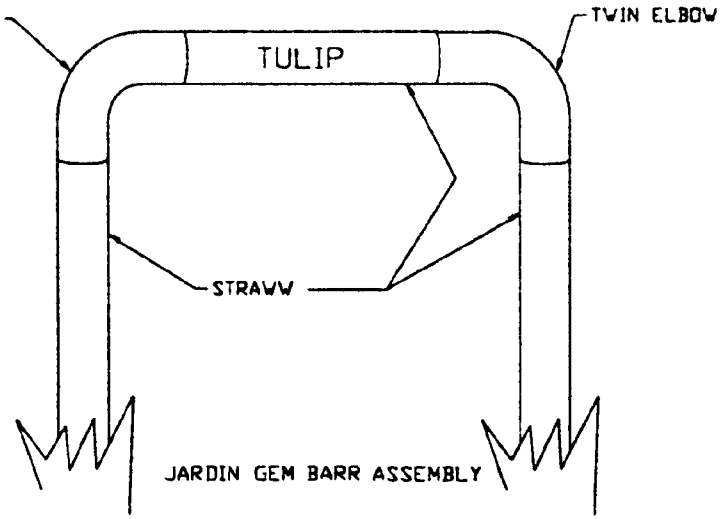
FIG. 8

JARDIN GEM, A SET OF IDENTIFIER STRATAGEMS, WITH ACCESSORIES

CROSS-REFERENCE TO RELATED APPLICATIONS

Not Applicable

STATEMENT REGARDING FEDERALLY-SPONSORED RESEARCH OR DEVELOPMENT

Not Applicable

REFERENCE TO MICROFICHE APPENDIX

Not Applicable

BACKGROUND OF THE INVENTION

Currently available through wholesale and retail sources are several types of markers used to identify plants.

There are short and tall stakes made of wire, wood, and/or plastic. Some stakes have a nameplate affixed thereto; others, require a tag to attach using wire, string, or floral tape.

Nameplates/tags/flags commonly are made of ceramic, copper, fabric, glass, paper, plastic, metal, and wood. Individual flags may be a small vinyl or cloth material with a preprinted name.

Popular combinations on the market are:

(1) STAKE OF PARALLEL WIRE LEGS WITH ATTACHED NAMEPLATE

At the top of parallel wire legs is attached a shaft that anchors a metal nameplate upon which the user writes the desired plant name then subsequently inserts in the soil.

(2) WIRE ROD STAKE WITH ATTACHED NAMEPLATE

These are single wire rods with a nameplate (usually zinc) upon which the user writes the plant name, then inserts in the soil. Some nameplates flip upwards allowing more data to be written on the reverse side.

(3) WOODEN STAKE

An individual wooden stake is used upon which sometimes the user writes a plant name then inserts in the soil. The user has the option to directly write on a tag, affix it with a wire to the wooden stake, then insert same in the soil.

(4) WOODEN TAG WITH NAME

Individual wooden tags are sold either plain or with a preprinted plant name thereon to be fastened to a plant.

(5) COPPER TAG WITH WIRE

Individual plain, soft copper tags are sold upon which the user writes the plant name. A hole at one end allows a wire to be threaded before fastening to the plant. This tag material is desirous because it weathers over time to a verdigris patina, blending with nature. Frequently, matching copper wire for attachment is sold with a tag.

(6) PLASTIC TAG WITH PLANT NAME

Individual plastic tags are inserted in the soil of house plant pots, greenhouse plantings, to identify perennials and annuals prior to sale. Customarily there are instructions thereon as to the individual plant's care.

Flexible wire floral tape also can be used for attaching a tag to a wire rod/a wooden pole-like plant marker.

The nameplate is differentiated from a tag because it is preaffixed on each individual stake. Some blank nameplates and metal tags are sold with the understanding the user must write the pertinent data with an electric engraving tool. When the nameplate material is soft copper, a ballpoint or stylus is required to write the plant's name which becomes permanent.

These above-mentioned choices of plant stakes/markers have a limited-time endurance and limited functionality; their only purpose is stay in the soil at various heights as identifiers. They are a temporary expediency and rather makeshift.

Wire plant stakes/markers often appear to look like huge hairpins, are rather wobbly, and must be carefully moved due to their propensity to easily deform.

Most of the stakes/markers are not an "end use purchase" requiring more handling which means it is necessary to take time writing identification on the nameplate/tag before tying it to a plant or tying it to a stake/marker.

A major disadvantage of these various stakes, markers, tags, and nameplates is their unremarkable appearance which detracts from any landscape. Moreover, they have a limited life and are easily lost, damaged, or deformed.

A Patent Search of the available years 1969 to 1997 was conducted at the Patent and Trademark Depository Library at Rutgers University, Piscataway, N.J.

This endeavor resulted in perusing over 670 garden-related Use Patents and 36 Design Patents.

However, all relevancies were distant:

Pat. No. D 247,590=garden marker

Pat. No. D 263,903=hose holder

Pat. No. D 282,711=garden marker stake

Pat. No. D 290,809=garden hose holder

Pat. No. D 331,526=garden stake

Pat. No. D 334,529=garden hose holder

Pat. No. D 343,775=garden stake

Pat. No. D 344,645=holder for garden hose nozzle

Pat. No. D 376,300=garden stake

U.S. Pat. No. 3,747,166=hose holder

U.S. Pat. No. 4,020,906=garden marker

U.S. Pat. No. 4,079,530=garden marker

U.S. Pat. No. 4,106,203=garden row marker

U.S. Pat. No. 4,177,864=garden crook

U.S. Pat. No. 4,534,125=garden row marker

U.S. Pat. No. 4,586,676=garden hose storage with guide

U.S. Pat. No. 5,301,481=garden stake

U.S. Pat. No. 5,333,391=garden marker apparatus

U.S. Pat. No. 5,487,235=support apparatus for fencing

U.S. Pat. No. 5,515,645=support item for fencing

U.S. Pat. No. 5,524,382=decorative ornament

There were additional "hose anchor and individual plant support-type" Patents. They, too, had a distant relationship:

U.S. Pat. No. 551,000=stake for plants: Dec. 10, 1895

U.S. Pat. No. 603,754=plant support: May 10, 1898

U.S. Pat. No. 687,283=plant support: Nov. 26, 1901

U.S. Pat. No. 1,479,532=hose holder: Jul. 13, 1922

U.S. Pat. No. 1,610,259=article holder: Nov. 24, 1924

U.S. Pat. No. 1,616,147=marking stake: Jan. 9, 1925

U.S. Pat. No. 1,693,393=plant support: Oct. 5, 1927

U.S. Pat. No. 2,013,447=holder for garden hose: Sep. 3, 1935

U.S. Pat. No. 2,173,217=support for plants: Sep. 19, 1939

U.S. Pat. No. 2,229,527=individual plant support Feb. 26, 1937

U.S. Pat. No. 2,894,706=hose support: Sep. 3, 1957

U.S. Pat. No. 5,088,666=hose anchors support: Feb. 18, 1992

BRIEF SUMMARY OF THE INVENTION

The invention "Jardin Gem" is a sophisticated, utilitarian set of identifier stratagems which comprises a primary device, a secondary device, and a tertiary device.

They are named:

#1=Jardin Gem Topper . . . the primary identifier device.

#2=Jardin Gem Straww . . . the secondary identifier device.

#3=Jardin Gem Barr . . . the tertiary identifier device.

Whereas #1 and #3 interrelate with #2, each can and will function independently. The set has three accessories:

#4=Jardin Gem Beadd (lettered bead with a hole)

#5=Jardin Gem Tagg (metal tag with a hole)

#6=Jardin Gem Bracelett (ball chain)

Each identifier stratagem is manufactured from a continuous length of premium noncorrosive metal tubing such as stainless steel, brass, copper, aluminum, et al and custom-formed. What makes the Jardin Gem different from any other type of identifier is its inherent quality metal tubing structural strength, permanency attributes, and versatility.

They offer a classic way to prominently identify botanical plant life at every growth stage as well as equally identifying objects/places/things in divergent ways for whatever purpose. Clearly readable choices are either (1) imprinted lettering on the metal tubing and (2) spelling out an identifying name using round or square beads.

The Jardin Gem Topper is made with one of several configured tops, chiefly geometrical shapes. While the top has other uses, it functions as a handle for insertion/extraction.

The opposite straight end of the column (standard) is for placement in the ground, soil, cement, predrilled wood, cored brick, or whatever object.

An individual Jardin Gem Topper may accomplish several tasks simultaneously. Functioning as identifier, it adequately can support a garden hose (watering, soaker, sprinkler); roping; surveyor's tape; ribbons; or a strings of electric lights which have been laced through a series of tops. Flowers; seed packets; placards; and signs can be attached (especially to a series of tops). Additionally, when positioned close to the ground, the handle now converts to a nonshifting guard holder.

There are several labeling variations to identify botanical plant life or objects/places/things. The metal tubing used for the Jardin Gem Topper, the Jardin Gem Straww, and the Jardin Gem Barr can be imprinted thereon with a name; a ball chain with lettered beads may hang from a Jardin Gem Topper or through requested predrilled cross holes; or a tag may be slide on any identifier stratagem which has a beading {a stop}.

The Jardin Gem Straww is a straight piece of matching noncorrosive stainless steel metal tubing available in various lengths. It mainly functions as an individual identifier stratagem . . . placement marker . . . to be inserted in the ground when the user is planting bulbs, seeds, and seedlings. Its relatively thin appearance makes for inconspicuousness among foliage.

Two other important uses are when the Jardin Gem Straww functions as:

(1) co-identifier with the Jardin Gem Topper and (2) as a bridge for the Jardin Gem Barr.

In example (1), a Jardin Gem Topper slides (temporarily) inside an individual Jardin Gem Straww while the top of the Jardin Gem Topper holds a garden hose.

After the need for watering is accomplished and when decided by the user, the Jardin Gem Topper is removed by being pulled upward at the same time holding downward the Jardin Gem Straww pushing the latter into the ground (or whatever object) to remain in place continuing as a lone identifier.

The Jardin Gem Barr is singular because it nests two noncorrosive metal tubular parts, labeled "elbow connector" bent at right angles, with a Jardin Gem Straww bridging between to form a wide span U-shaped bar.

There are two types of elbow connectors: "single" and "twin" used in pairs with one or three Jardin Gem Strawws.

(A) The "single" elbow connector has a short neck end and a long neck end. The short neck end is swaged while the long neck is plain.

(B) The "twin" elbow connector has two short neck ends both of which are swaged.

After inserting a Jardin Gem Straww between a pair of "single" elbow connectors, it results in a low-height Jardin Gem Barr. After inserting a Jardin Gem Straww between a pair of "twin" elbow connectors and inserting one Jardin Gem Straww at each side, it results in a raised-high Jardin Gem Barr.

Either type of "single" or "twin" elbow connectors used in this fashion creates a Jardin Gem Barr which looks similar to a furniture cabinet pull handle.

All parts may be disengaged for reuse or storage.

The user has several identification options. The span (Jardin Gem Straww) can be imprinted with a name. If preferred, after collecting the necessary letters to spell an identifying name, accordingly, the user can slide large-size Jardin Gem Beadds onto any span length of a Jardin Gem Barr or onto a Jardin Gem Bracelett to hang.

Accessory Jardin Gem Beadd is a bead with a single letter, mark, or number thereon. There are small and large sizes. They are either round or square in shape.

The labeling selection of beads encompasses preprinted choices of digits zero to nine; spacers; punctuation marks; and A to Z alphabet characters to spell out the desired name(s).

Both sizes of Jardin Gem Beadd can thread onto a Jardin Gem Bracelett. Large beads are restricted to fit only on the Jardin Gem Topper, Jardin Gem Straww, and Jardin Gem Barr.

Accessory Jardin Gem Bracelett is a common metal ball chain available in lengths to accommodate the number of beads needed whether small or large size Jardin Gem Beadds. A Jardin Gem Bracelett is attached as a user determines.

Accessory Jardin Gem Tagg is blank, a flat metal tag in rectangular, square, and round forms made of a matching noncorrosive metal as the identifier stratagems. Tag material also may be made of soft copper for those users who prefer to write . . . print . . . their own identification data. There are two hole sizes, small or large, for connecting purposes. The Jardin Gem Bracelett accommodates both hole sizes; whereas only the tag with the large hole will slip to hang on the Jardin Gem Topper, Jardin Gem Straww, and/or the Jardin Gem Barr.

The Jardin Gem Tagg may fasten through cross holes with a wire, ball chain, split ring, etc. It can be slid onto the column standard which has a beading {a stop}.

A Jardin Gem in unison with each other and accessories provides ways to temporarily/permanently identify botanical plant life, objects, places, things, or whatever.

Another advantage of noncorrosive metal tubular is its composition, in particular stainless steel, which provides beauty, visibility, and strength. That type of metal material is impervious to weather and lawn chemicals. More importantly, metal is recyclable as well as nontoxic thus friendly to the environment.

Because of the Jardin Gem's originality and versatility, its usefulness will be limited only by the imagination.

(A) plain (B) with letter name on the column underneath the top (C) with cross holes below the top (D) with Jardin Gem Beadds spelling "TULIP"+farther down beading {a stop}

(E) with cross holes+beading {a stop}

(F) with plain Jardin Gem Straww slipped onto its column (standard)

(G) Jardin Gem Straww slipped onto its column (standard) with "TULIP" lettering printed (H) Jardin Gem Topper removed from Jardin Gem Straww (I) Jardin Gem Straww stands alone in the soil (J) hanging Jardin Gem Tagg with "TULIP" name (K) plain Jardin Gem Bracelett hangs from a top (L) Jardin Gem Bracelett with Jardin Gem Beadds "TULIP" threaded hangs through cross holes FIG. 6 shows two versions of the Jardin Gem Barr.

(A) identifies a "single" elbow connector having a short neck and a long neck . . . only the short neck has a swaged end designed to fit into the I. D. (inside diameter) of a Jardin Gem Straww (B) identifies a "twin" elbow connector having two short necks both with swaged ends FIG. 7 identifies Jardin Gem Barr comprising two "single" elbow connectors fitted into the I. D. (inside diameter) of a Jardin Gem Straww. The two opposite long necks serve as legs to place in the ground/object/place/thing.

FIG. 8 identifies two "twin" elbow connectors and three companion Jardin Gem Strawws fitted into each other and placed in the ground to achieve a higher elevated position.

Figure 1:
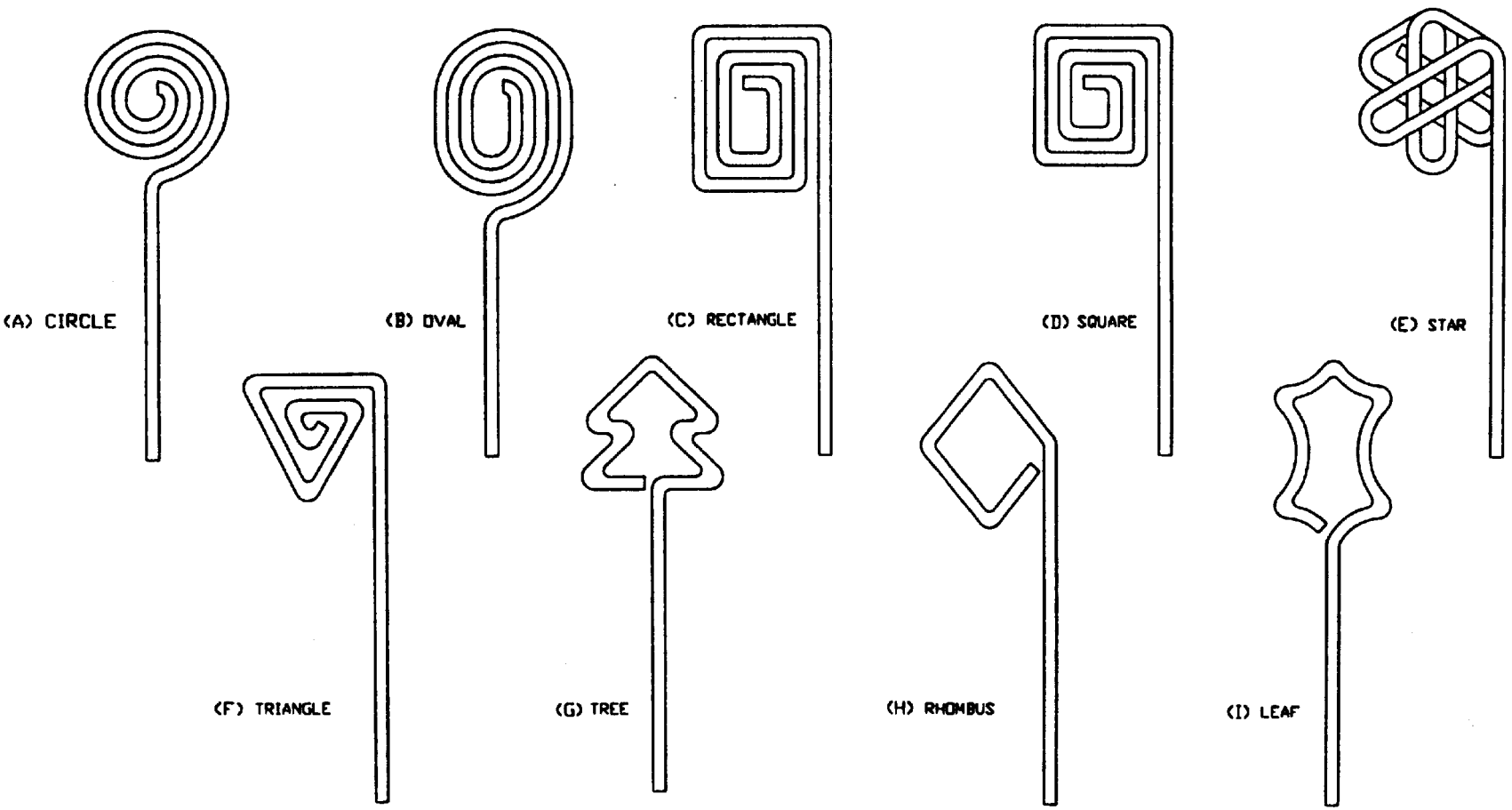
FIG. 1 shows nine Jardin Gem Topper identifier stratagems profiling the side views of (A) circle, (B) oval, (C) rectangle, (D) square, (E) star, (F) triangles (G) tree, (H) rhombus, and (I) leaf shapes. Tubing is multiple wrapped.
Figures 2, 3, 4:
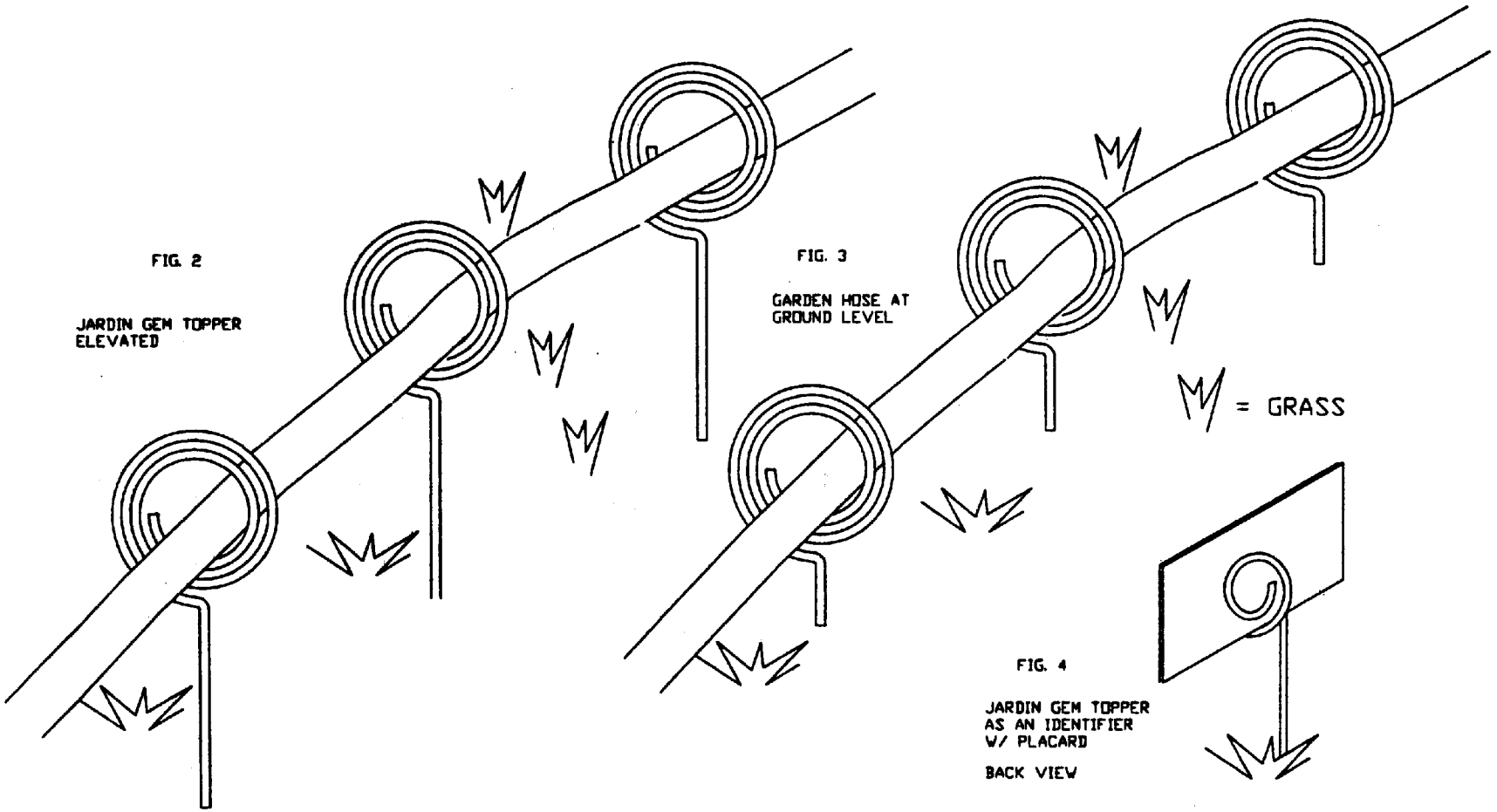
FIG. 2 shows a several elevated circle-type Jardin Gem Toppers with a garden hose laced through their tops, showing grasses beneath.
FIG. 3 shows several circle-type Jardin Gem Toppers about ground level with a garden hose laced through their tops, showing grasses beneath.
FIG. 4 shows a Jardin Gem Topper as an identifier with a placard held between the top's circle bends.
Figure 5:
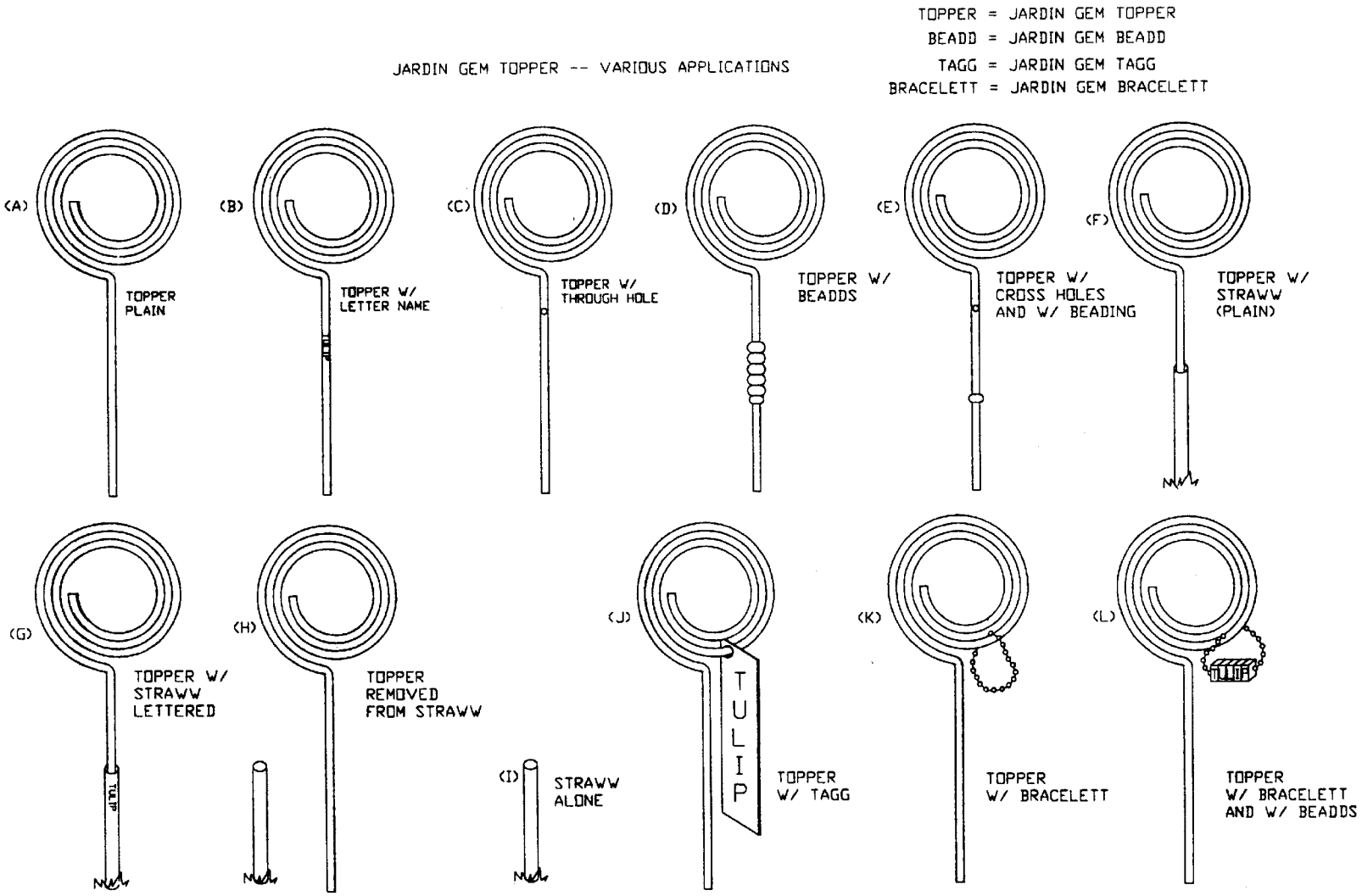
FIG. 5 shows versions of a circle Jardin Gem Topper.
Figure 9:
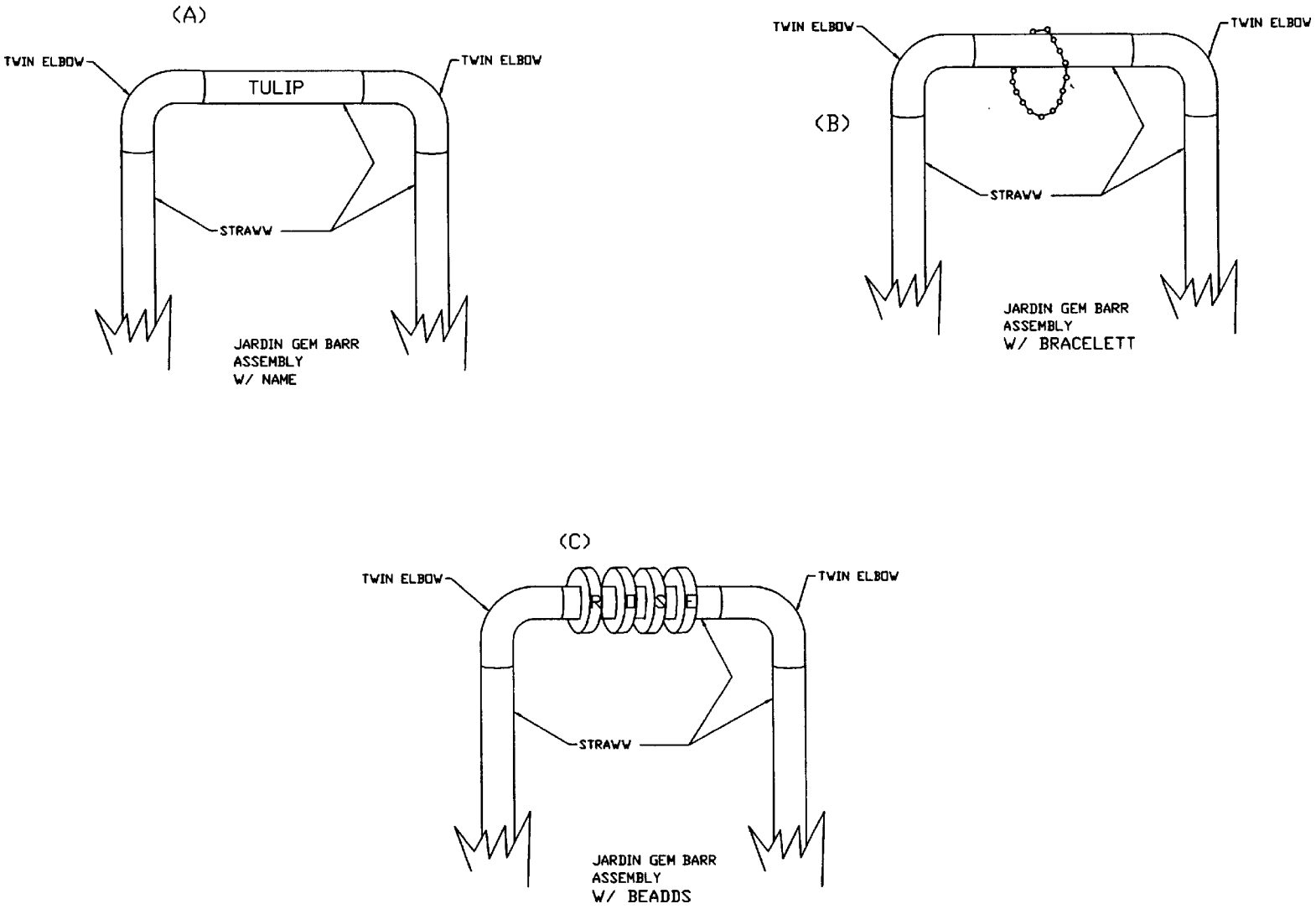
Figure 10:
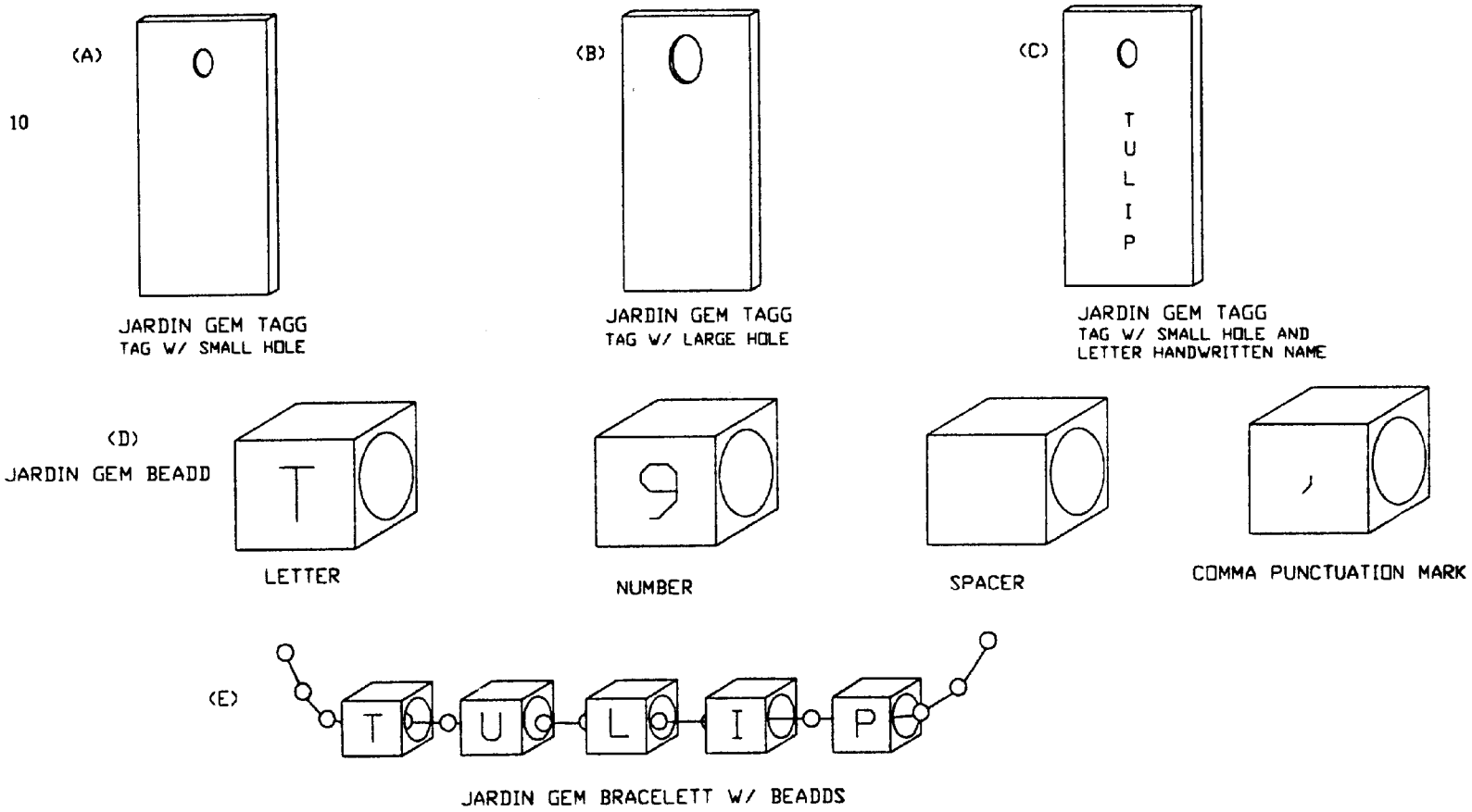

FIG. 9 identifies:

(A) Jardin Gem Barr with "TULIP" lettered in center (B) Jardin Gem Bracelett hanging from the center (C) Jardin Gem Beadds slide on Jardin Gem Straww FIG. 10 identifies:

(A) Jardin Gem Tagg with small center hole (B) Jardin Gem Tagg with large center hole (C) Jardin Gem Tagg with small center hole with with handwritten name (D) three Jardin Gem Beadds shown with a letter, a number symbol, and comma punctuation mark (E) The Jardin Gem Bracelett is a ball chain upon which appropriately selected imprinted beads, Jardin Gem Beadds, are slid thereupon. Selected beads spell out the desired name using beads with letters/characters/numbers/punctuation marks. These Jardin Gem Beadds are slid onto a Jardin Gem Bracelett. In turn, the latter can hang from the top of an individual Jardin Gem Topper or hang from a Jardin Gem Barr.

DETAILED DESCRIPTION OF THE INVENTION

Jardin Gem is an invention of a sophisticated, utilitarian set of identifier stratagems. The set comprises primary, secondary, and tertiary identifiers and three interchangeable, companion accessories. These three basic components by position can be changed from vertical to horizontal identifiers. They are versatile, easily movable from place-to-place. The mutual name "Jardin Gem" is incorporated as a prefix to each device and companion accessory. The set is:

#1=Jardin Gem Topper . . . the primary identifier device.

#2=Jardin Gem Straww . . . the secondary identifier device.

#3=Jardin Gem Barr . . . the tertiary identifier device.

Whereas #1 and #2 interrelate with #3, each can and will function independently. Each of the aforementioned identifier stratagems is manufactured from a continuous length of premium noncorrosive round metal tubing such as stainless steel, brass, copper, aluminum, et al and is custom-formed.

Material for an identifier stratagem is not limited to round tubing but flat oval, elliptical oval, hexagon, octagon, square, and rectangular tubing material can be used.

What makes these Jardin Gems different from other types of markers is its inherent quality metal tubing structural strength, permanency attributes, and versatility.

They offer a classic way to prominently identify botanical plant life as well as identifying objects/places/things in divergent ways for whatever purpose. Clearly readable choices are (1) imprinted lettering on the metal tubing itself and (2) spelling out an identifying name with round or square beads.

When a Jardin Gem Topper is made of round tubing and is to be used with a companion Jardin Gem Straww, the latter must be round tubing in identical metal. Likewise, when a Jardin Gem Topper is made of square tubing used with a companion Jardin Gem Straww, the latter must be square tubing in identical metal.

Unless a different material is requested, every identifier stratagem is made of noncorrosive stainless steel metal tubing.

The most popular measurement to be used for these devices is round metal tubing with a 0.250" O. D. (outside diameter). Also available for heavier applications is round metal tubing with a 0.375" O. D. and/or 0.4375" O. D.

General length would be determined by purpose manufactured in increments of six inches (6") beginning with a basic height of 18 inches. A Jardin Gem Topper would be made in these lengths:

=18 inches (18")

=24 inches (24")

=30 inches (30")

=36 inches (36")

=42 inches (42")

=and custom-ordered lengths

Numerous merits prevail when using metal tubing. Metal in this form is as rigid as similar diameter rod . . . but much lighter.

There are no sharp ends; the metal is deburred in the manufacturing process; and it smooth to touch. Tubing by definition is hollow thereby permitting air, moisture, water, soil to travel through.

Never conducive to deterioration and equally impervious to weather/lawn chemicals make stainless steel tubing the most desirable metal.

In conjunction with a set of Jardin Gem identifier stratagems, there are three metal companion accessories. Here, too, the prefix "Jardin Gem" is employed. They are:

#4=Jardin Gem Beadd (lettered bead with a hole)

#5=Jardin Gem Tagg (metal tag with a hole)

#6=Jardin Gem Bracelett (ball chain)

The reason for spelling five of the Jardin Gem products with the repeated letter is strictly stylized.

It evolved because Jardin Gem Topper has two "p's" and all the names would be uniform by doubling the last letter.

Thus, Straww, Barr, Beadd, Bracelett, and Tagg really are intended to be fancy spellings.

These stratagems and accessories are unique because they afford the user a combination of options by mixing and matching identification needs.

An individual Jardin Gem identifier stratagem can:

(a) be personalized directly on the metal tubing (b) use beads to spell a name and slide thereon (c) use letters to spell a name and thread on a chain Although the set of three identifier stratagems has been devised principally for labeling botanical plant life, it is not restricted to only that application.

Other identification uses to meet situations are limited only by the imagination.

The companion accessory known herein as "Jardin Gem Beadd" actually is an everyday product. Individual beads with letters and numbers currently are a jewelry fad among children and young adults. Nomenclature in the trade varies depending upon which distributor or manufacturers representative with whom you converse. They are sold as "fun beads," "alpha beads," or "alpha blocks" assembled to make prevailing novelty items and personalized jewelry. It is reported these beads are an import item from the Orient.

Beads used in conjunction with a Jardin Gem genuinely is a mere readaptation, an employment in an unusual corroboration which follows.

The Jardin Gem Tagg is a metal tag, in several shapes, imprinted with lettering lending itself to a host of various applications.

Actually, the Jardin Gem Bracelett is another name for a novel usage of the ball chain which has been around for years. To cite a few examples, there are the "on/off" chain for ceiling fans; the pull cord chain for a light, and the key chain holder.

Reverting to the main purpose of this invention, Jardin Gem is thought to be a superior, different method to mark plants.

Each of the three Jardin Gem identifier stratagems can conveniently differentiate any type of botanical plant life at all growth stages, prior to, during, and after maturity in every season. This includes perennials; annuals; bulbs; plants; shrubs; herbs; fruits; vegetables; deciduous/nondeciduous trees.

The problem solved is avoid after-the-fact repeating a digging effort in the same location whence something was planted.

Using a Jardin Gem eliminates guesswork and double-digging confusion. A single Jardin Gem Straww identifier stratagem placed in the ground as one plants makes it easy to follow a garden layout, marking it "in situ." This affords immediate reference should replanting be contemplated.

#1 JARDIN GEM TOPPER

The primary identifier stratagem is called a Jardin Gem Topper with which two others coordinates. This device is made of a continuous length of noncorrosive metal tubing, primarily stainless steel, et al and can be either round or square tubing. There is the selection of one of nine or more proposed ornamental tops above its column (standard) dually functioning as a handle to push in/pull out (insertion/extraction) and as a type of holder. The opposite end of the column (standard) is straight easily wiggled into soil, pre-drilled wood, placed in a cored brick, or whatever object.

The top shapes (tubing is multiple wrapped) are mostly geometrical; rectilinear or curvilinear motif designs lend themselves to be superior supports for the uses presented.

These configurated tops currently presented are made in: (A) circle, (B) oval, (C) rectangle, (D) square, (E) star, (F) triangle, (G) tree, (H) rhombus, and (I) leaf shapes.

A Jardin Gem Topper's ornamental top sometimes can hide from view simply by raising or lowering its height in rhythm with growing botanical plant life.

Some various applications for this device are:

(1) Delineate and mark off an area/space.

(2) Position to attach burlap for use as plant protection.

(3) Position to attach fencing; hold screening; et al.

(4) Lace a garden hose (watering soaker, sprinkler) through the tops of a series of Jardin Gem Toppers.

(a) When placed hugging parallel inches to ground level, the tops functions as hose guards. The importance here: the device is made of stainless steel thus sturdy enough not to shift and bright enough to be visible. A hose would be accessible when placed alongside a building foundation.

(b) They can support a watering hose elevated at varying heights above ground level. When a soaker or sprinkler hose is desired to encourage plant growth, these identifier stratagems can be raised or lowered with the progress of seeds germinating and bulbs maturing.

(c) Attach one end of a garden hose which has been laced through several tops to an exterior faucet. When needed, said hose is there in place and eliminates hose shifting.

(d) Take a two watering hoses laced through the tops and attach to a manifold connector on an exterior faucet. Each hose going in opposite directions. Attach couplings on the open ends. When needed, said hose is in position to attach another hose eliminating carting another hose to connect.

(e) Lace a selected object through the tops to serve as a keeper retaining same in orderly arrangement.

(f) Depending on the event, the Jardin Gem Topper can be positioned with placards inserted thereon to identify a path/space/area for enhancement using roping, ribbons, surveyor's tape, floral bouquets, electric string lights, etc., laced/tied through the ornamental tops.

To make it more useful, the Jardin Gem Topper can have cross holes with or without a beading {a stop}.

When a name is desired, there are three options.

(1) Below the ornamental personalization can be imprinted on the metal column (standard).

(2) Lettered large-size Jardin Gem Beadds can be slid on the metal column (standard) to spell a name and rest on the beading {a stop} referred in the last paragraph.

(3) Lettered small-size Jardin Gem Beadds spelling a name can be strung on a Jardin Gem Bracelett to be inserted in the cross holes previously mentioned.

(4) The Jardin Gem Bracelett can hang from the top of a Jardin Gem Topper.

This Jardin Gem Topper has such expeditious uses like tying a rope to maintain a small boat at the shoreline; holding fishing tackle; slide a rope through to drag an object; or keeping an object held open or closed. Note: stainless steel metal is sturdy and cannot be hand bent.

#2 JARDIN GEM STRAWW

The secondary identifier stratagem is the Jardin Gem Straww made of matching noncorrosive metal tubing. As its name implies, the device resembles a beverage drinking straw. It is made of a a single, straight length of matching metal tubing but stands alone or functions as a sleeve with a Jardin Gem Topper.

A Jardin Gem Straww . . . whether round or square tubing . . . is manufactured in multiples of six-inch and eight-inch lengths and special order lengths.

When used in gardening, the Jardin Gem Straww's position can be altered according to the height of the plant's growth.

The several other benefits of using the Jardin Gem Straww is being easy to raise and lower; slim in design making it rather inconspicuous to conceal hide among flowers, shrubs, bushes; compatible with the Jardin Gem Topper; and removable at the user's discretion.

One of the principle features of the Jardin Gem Straww is it slides on the outside of a Jardin Gem Topper's column (standard) to temporarily be a co-identifier . . . while a sprinkler hose above laced in a series of ornamental tops waters new/mature botanical plant life growing below. Later, it can be slipped off and be an individual marker.

To disengage, for example after the need for watering is sufficient and when decided by the user, the procedure is practically effortless. The Jardin Gem Topper is pulled upward while simultaneously pushing downward the Jardin Gem Straww in the opposite direction to the ground (or whatever object) allowing the Jardin Gem Straww to remain as a sole identifier.

Or, after plant projects above the earth, the individual Jardin Gem Straww can be slipped off its companion Jardin Gem Topper and reinserted elsewhere.

When a Jardin Gem Straww identifying stratagem is used as a companion with a Jardin Gem Topper, the name marked on each metal tubular component may or may not be identical.

To accomplish functioning as a co-identifier, an individual Jardin Gem Straww's I.D. (Inside Diameter) measurement is dictated by whatever is the prevailing the companion individual Jardin Gem Topper's O. D. (Outside Diameter) measurement.

An example: When the Jardin Gem Straww has a 0.250" I. D. measurement, then it is mandatory the Jardin Gem Topper has a 0.250" O.D. measurement in order to enable slipping on and off the individual Jardin Gem Topper.

The Jardin Gem Straww can be personalized, imprinted with a name, manufactured according to one of the following choices:

(1) blank;

(2) blank+cross holes at one end to attach a Jardin Gem Bracelett;

(3) blank . . . to function as a bridge fitting between two Jardin Gem Barr "single" elbow connectors so large-size lettered #4 Jardin Gem Beadds can slide thereon to spell a name;

(4) blank . . . to function as a bridge fitting between two Jardin Gem Barr "twin" elbow connectors so large-size lettered #4 Jardin Gem Beadds can slide thereon to spell a name;

(5) imprinted with a name one inch (1") from an end;

(6) imprinted with a name one inch (1") from an end+ cross holes at the opposite end allowing future attachment of a Jardin Gem Bracelett;

(7) imprinted with a name one inch (1") from each end so to be reversible;

(8) personalized with a name imprinted in the center when used as a bridge between either of the Jardin Gem Barr's "single" or "twin" elbow connectors;

(9) have cross holes at one end to attach a Jardin Gem Bracelett;

(10) have beading {a stop} to slide Jardin Gem Beadds thereon spelling a name; and

(11) have beading {a stop} to slide Jardin Gem Beadds thereon spelling a name and cross holes at the opposite end for attaching a Jardin Gem Bracelett.

This identifier stratagem is ideal to mark special flower beds and vegetable garden row arrangements.

#3 JARDIN GEM BARR

This tertiary identifier stratagem is singular because it nests (only temporarily) two noncorrosive stainless steel metal tubular parts, labeled "elbow connectors" bent at right angles, with a Jardin Gem Straww bridging, between to form a wide span U-shaped bar. There are two types of elbow connectors: "single" and "twirl" used in pairs with one or three Jardin Gem Strawws.

(A) The "single" elbow connector has a short neck end and a long neck end. The short neck end is swaged while the long neck is plain.

(B) The "twin" elbow connector has two short neck ends both of which are swaged.

After inserting a Jardin Gem Straww between a pair of "single" elbow connectors, it results in a low-shank height Jardin Gem Barr.

After inserting a Jardin Gem Straww between a pair of "twin" elbow connectors and one Jardin Gem Straww at each side, it results in a high-shank height Jardin Gem Barr.

Either type of "single" or "twin" elbow connectors used in this fashion creates a Jardin Gem Barr which looks like a furniture cabinet pull handle.

Both elbow connectors are manufactured in an assortment of heights, sizes, and lengths. Parts, of course, may be disengaged for reuse and storage.

When a short Jardin Gem Straww is used for the center span, a Jardin Gem Bracelett with Jardin Gem Beadds can be hung from same.

Another option is to spell an identifying name by sliding large-size Jardin Gem Beadds onto the center span of the Jardin Gem Barr to display a name.

A Jardin Gem Straww's length varies to accommodate a lengthier identification name.

It is thought, from an educational point-of-view, that parks and gardens would benefit bad using individual Jardin Gem Barrs to identify botanical plant life and a low-shank height is ideal to place in front of the base of a tree to so identify.

#4 JARDIN GEM BEADD

The first accessory, Jardin Gem Beadd, is available with two hole sizes . . . small and large . . . with two sizes of beads also small and large. The beads are round and square shaped.

The round bead has a solitary letter whereas the square bead is lettered on four rotating sides. Each bead by definition has a center hole. Preference dictates.

Selection of lettering encompasses digits zero to nine; spacers; punctuation marks; and A to Z alphabet characters to to spell identification names.

A Jardin Gem Beadd can thread onto a Jardin Gem Bracelett. Only a large hole bead fits onto the Jardin Gem Topper, Jardin Gem Barr, and Jardin Gem Straww.

Here are some options:

(a) individual lettered small-size Jardin Gem Beadds spell a name and thread on a Jardin Gem Bracelett to hang from the ornamental top of a Jardin Gem Topper;

(b) individual lettered small-size Jardin Gem Beadds spell a name and thread on a Jardin Gem Bracelett to hang through predrilled cross holes on the ornamental top of a Jardin Gem Topper or simply hang thereon; and (c) individual lettered large-size Jardin Gem Beadds slide on a Jardin Gem Topper, Jardin Gem Barr, and a Jardin Gem Straww.

#5 JARDIN GEM BRACELETT

The second accessory, Jardin Gem Bracelett, is a metal ball chain which can be attached as preferred. It is available in various lengths correlating with the number of beads to spell a desired name.

Repeating, a Jardin Gem Bracelett can hang from a Jardin Gem Topper; thread through cross holes of the Jardin Gem Topper; thread through cross holes of a Jardin Gem Straww; and attach for hanging from a short-span Jardin Gem Barr.

Another convenience is to employ a wire (detachable circular locking ring/ribbon/string) fastened through cross holes to hold a limited number of Jardin Gem Beadds.

#6 JARDIN GEM TAGG

The third accessory, Jardin Gem Tagg, is a metal tag and may be circular, square, rectangular in shape depending upon the amount of information to be printed thereon.

When copper, brass, or bronze metals are used subsequently exposed to the elements, they weather to a desirable verdigris patina . . . green or greenish. The attractive green color blends with nature's foliage.

Some metals will require personalization with an engraving tool. Favored is a plain flat rectangle tag when the material made of impressionable metal of soft copper which allows the user to inscribe with a stylus/ball point pen.

The Jardin Gem Tagg is available with the choice of a small pierced center hole at one end or a large pierced center hole at one end.

The smaller hole tag is compatible with a Jardin Gem Bracelett while the large hole tag fits onto the top of a Jardin Gem topper to hang OR on a Jardin Gem Straww kept in place by a beading {a stop} on a Jardin Gem Straww when used as a bridge for creating a Jardin Gem Barr.

Broaching the subject of lettering directly on the metal tubing, the method of marking of name would be one of the following methods. Price and demand, of course, being the determining factors in selecting which method to use:

(A) debossment (B) embossment (C) impact marking (D) indent marking (E) laser marking (F) manual marking (G) press marking (H) roll marking, et al The production volume/requested preference will dictate the imprint method. Lettering will be high quality, crisp, and distinct.

The Jardin gem is our original invention with the thought in mind to (A) support any variety of garden hoses (watering, soaker, sprinkler hoses:, and other objects and to (B) function as individual identifier stratagems to label any botanical plant life prior to (especially at the planting stage), during, and after maturity . . . including botanical plant life already matured . . . and other objects/places/things.

These identifier stratagems are manufactured of premium noncorrosive material such as stainless steel, brass, copper, aluminum, et al and custom-formed. This metal tubing is strong; will not deteriorate; is impervious to weather elements and lawn chemicals.

Although the material used is prime noncorrosive stainless steel tubing, the Jardin Gems identifier stratagems also can be manufactured of other quality noncorrosive metal tubing material just mentioned according to request.

What makes the Jardin Gems different from other types of identifiers is its inherent quality metal tubing structural strength, permanency attributes, and versatility.

They offer a classic way to prominently identify botanical plant life at every growth stage as well as equally identifying objects/places/things in divergent ways for whatever purpose.

Identification is accomplished two ways: (1) to have imprinted lettering directly on the metal tubing or (2) to utilize a combination of mixing/matching accessories spelling with readable, distinct lettered beads English/Latin names.

Jardin Gem is an invention of a sophisticated, utilitarian set of identifier stratagems which comprises a primary device, a secondary device, and a tertiary device each custom-formed.

These are interrelated devices which completely function either independently or in unison with each other.

The mutual name "Jardin Gem" is incorporated as a prefix to each device and companion accessory. The set is:

#1=Jardin Gem Topper . . . the primary identifier device.

#2=Jardin Gem Straww . . . the secondary identifier device.

#3=Jardin Gem Barr . . . the tertiary identifier device.

An explanation of the spellings for the five of the Jardin Gem products is in order. The nomenclature with the double letters is strictly for style which evolved from the fact Jardin Gem Topper has two "p's." For uniformity, spelling was stylized to be in agreement by repeating the last letter. Thus, Straww, Barr, Beadd, Bracelett, and Tagg ace fancy spellings.

These three basic components by position can be changed from vertical to horizontal identifiers.

This invention presents new, alternative identification methods: labeling imprinted on the metal tubing and using accessory beads/tags with or without ball chains.

Of equal importance are three companion accessories which are generic, common products (beads, tags, and ball chain) compatible to the Jardin Gem set of identifier stratagems.

These accessories are:

#4=Jardin Gem Beadd (lettered bead with a hole)

#5=Jardin Gem Tagg (metal tag with a hole)

#6=Jardin Gem Bracelett (ball chain)

The companion accessory referred to as "Jardin Gem Beadd" is an everyday product. Individual lettered/numbered beads currently are a jewelry fad. The generic product name varies, known as "fun beads," "alpha beads," and/or "alpha blocks" which are assembled to make prevailing novelty items and personalized jewelry. It is reported these beads are an import item from the Orient. However, the plan is to manufacture our own beads from metal tubing.

The labeling selection of beads encompasses preprinted choices of digits zero to nine; spacers; punctuation marks; and A to Z alphabet characters to spell out desired name(s).

These beads in small/large sizes and in round/square shapes are threaded on wire/ball chain/split ring. The latter is referred to as a Jardin Gem Bracelett.

A metal tag is referred to as Jardin Gem Tagg and is made of a firm metal as well as soft copper (upon which to write/print) available in different shapes and sizes. The tag can slide on the Jardin Gem Topper, Jardin Gem Straww, and Jardin Gem Barr.

Beading {a stop} incorporated. on the metal tubing prevents the tag from falling off. A tag can be threaded on a ball chain, referred to as Jardin Gem Bracelett, or through cross holes in the tubing of the Jardin Gem Topper and the Jardin Gem Straww. Accessories are used uniquely with each Jardin Gem.

The primary identifier stratagem called a Jardin Gem Topper both functions as support holder and an identifier.

This device can be a lone support for a garden hose as well as certain other objects OR be a sole identifier of objects, places, things OR simultaneously be both a support holder and an identifier when imprinted on its column. Manufactured from a continuous length of noncorrosive metal tubing, such as stainless steel, brass, copper, aluminum, et al and custom-formed.

It has one of nine or more proposed ornamental tops above its column (standard). The tops currently presented are in the shape of a circle, oval, rectangle, square, star, triangle, tree, rhombus, and leaf. Other tops can be designed but perhaps the jest of the idea would be lost.

These configured tops are graceful, unobtrusive, and convenient to maneuver. They were designed to incorporate a form having adequate strength to be supportive.

Each decorative motif top serves interchangeably as a handle when the opposite straight end of the column (standard) is to placed in the ground, soil, cement, predrilled wood, cored brick, or whatever object.

Chiefly, the Jardin Gem Topper is used to mark botanical life plants prior to, during, and after maturity while at predetermined times hold a type of garden hose (watering, soaker, sprinkler) laced through a series of tops to promote growth.

A Jardin Gem topper identifier stratagem is used to mark numerous placement of plants and objects/places/things in a variety of ways with an auxiliary identifier Jardin Gem Straww. The latter may be slid onto a Jardin Gem topper, later separated to continue in the identical place previously inserted as a sole identifier alongside said plant. Both the Jardin Gem Topper and the Jardin Gem Straww can be/lowered as the plant grows.

With certain applications of positioning, said garden hose easily can be disconnected and moved to another area.

When a series of the Jardin Gem Topper is fitted close to ground level, it converts to a group of stationary guards, keeping whatever hose laced through its tops neat from shifting.

There is a variety of arrangements for lacing a garden hose (a lengthy section or combination of hoses) through the tops then attaching to a manifold connected to an exterior faucet. The results:

==Hose(s) is/are readily accessible and convenient;

==Neat appearance eliminating a scattered hose about the property; and

==With ease, a garden hose (watering, soaker, sprinkler) can be elevated/lowered to various heights.

Depending on the event, when functioning as a holder, a Jardin Gem Topper can be positioned in a series to mark/identify a path/space/area by lacing through its tops roping, ribbons, surveyor's tapes, floral bouquets, electric string lights, etc.

Labeling by name is achieved by selecting a lettered name imprinted on the metal or utilizing tags/beads/ball chains.

The secondary identifier stratagem Jardin Gem Straww resembles a beverage drinking straw. It is also manufactured from a continuous length of premium noncorrosive metal tubing, such as stainless steel, brass, copper, aluminum, et al and custom-formed.

It can function independently or as a co-identifier with an individual Jardin Gem Topper. Whether round or square tubing, it is manufactured in multiples of six-inch and eight-inch lengths and special order lengths.

When used in gardening, the Jardin Gem Straww's position can be altered according to the height of the plant. It is easy to quickly raise/lower/remove at the user's discretion. Slim design makes the Jardin Gem Straww rather inconspicuous among flowers, shrubs, bushes, etc.

One of its principle features is the Jardin Gem Straww slides on the outside of a Jardin Gem Topper's column (standard) to temporarily be a co-identifier while a sprinkler hose above laced in a series of ornamental tops can be used to water new/mature botanical plant life growing below. Later, a Jardin Gem Straww can be slipped off the column standard and function as an individual identifier stratagem.

To disengage from the Jardin Gem Topper, after the need for watering is adequate, the procedure to remove the Jardin Gem Toppers is simple. Each is removed by being pulled upward while simultaneously holding steadfast its co-identifier, the Jardin Gem Straww, pushing the latter firmly in the opposite direction into the ground (or whatever object) leaving it to remain in place continuing as a sole identifier. Or, after plant projects above the earth, the Jardin Gem Straww can be slipped off the Jardin Gem Topper and reinserted elsewhere.

To accomplish functioning as a co-identifier, an individual Jardin Gem Straww's I.D. (Inside Diameter) measurement dictates the companion Jardin Gem Topper's O. D. (Outside Diameter). measurement. An example: When the Jardin Gem Straww has a 0.250" I. D. measurement, it is mandatory the Jardin Gem Topper has a 0.250" O.D. measurement in order to enable slipping on and off the individual Jardin Gem Topper. Jardin Gem Straww is manufactured according to one of the following choices:

(a) blank;

(b) blank+cross holes at one end to attach a Jardin Gem Bracelett;

(c) blank . . . to function as a bridge extender fitting between two Jardin Gem Barr "single" or "twin" elbow connectors with a Jardin Gem Straww to accommodate large-size lettered Jardin Gem Beadds slipped thereon to spell a name;

(d) imprinted with a name one inch (1") from an end;

(e) imprinted with a name one inch (1") from an end+ cross holes at the opposite end allowing (future) attachment of a Jardin Gem Bracelett;

(f) imprinted with a name one inch (1") from each end so to be reversible;

(g) imprinted with a name centered name when used as a bridge for a Jardin Gem Barr;

(h) cross holes at one end to attach a Jardin Gem Bracelett;

(i) with beading {a stop} to slide Jardin Gem Beadds thereon spelling a name; and (j) with beading {a stop} to slide Jardin Gem Beadds thereon spelling a name with cross holes at the opposite end allowing future attachment of a Jardin Gem Bracelett (or wire, split ring, etc.).

When a Jardin Gem Straww identifying stratagem is used as a co-identifier with a Jardin Gem Topper, the name marked on each metal tubular device:

=may or may not be identical

=each may or may not have a beading {a stop}

=each may or may not have predrilled cross holes.

This identifier stratagem is ideal to mark special flower beds and herb/vegetable garden arrangements.

The tertiary identifier stratagem Jardin Gem Barr is also manufactured from a continuous length of premium non-corrosive metal tubing, such as stainless steel, et al and custom-formed. It has three parts: a single Jardin Gem Straww and two elbow connectors.

This particular identifier is singular because it nests but only temporarily two noncorrosive stainless steel metal tubular parts, labeled "elbow connectors," with a Jardin Gem Straww between. They elbow connectors are bent at right angles. There are two types of elbow connectors: "single" and "twin" used in pairs with one or three Jardin Gem Strawws to form a wide span U-shaped bar.

(A) The "single" elbow connector has a short neck end and a long neck end. The short neck end is swaged while the long neck is plain.

(B) The "twin" elbow connector has two short neck ends both of which are swaged.

After inserting a Jardin Gem Straww between a pair of "single" elbow connectors, it results in a low-shank height Jardin Gem Barr.

After inserting a Jardin Gem Straww between a pair of "twin" elbow connectors and a Jardin Gem Straww at each side, it results in a high-shank height Jardin Gem Barr. Either type of "single" or "twin" elbow connectors used in this fashion creates a Jardin Gem Barr which looks like a furniture cabinet pull handle. Parts may be disengaged for reuse and storage. Since both elbow connectors are manufactured in an assortment of heights, sizes, and lengths, there are many variations.

The Jardin Gem Straw may be blank or imprinted thereon When a short Jardin Gem Straww is used for the center span to construct a Jardin Gem Barr, a Jardin Gem Bracelett with Jardin Gem Beadds can be hung from same. Another option for the user is to spell an identifying name by sliding large-size Jardin Gem Beadds onto the center span (Jardin Gem Straww) of the Jardin Gem Barr to display a name. A longer Jardin Gem Straww is needed to accommodate a lengthier identification name.

The low-shank height of a Jardin Gem Barr is ideal to place in front of the base of a tree trunk for identification purposes, especially noteworthy when the tree is leafless.

We reiterate these claims are our original invented methods for identifying purposes offering versatile applications using metal tubing material and interchangeable accessories.

Because these identifiers are made of superior material, namely premium metals, they provide strong, unbreakable supports; will not rust; impervious to weather elements and lawn chemicals; enhance a property; always look pleasing; are safe to use; can be recycled; and will NOT harm the environment.

Commentary

The true advantages of using a Jardin Gem set of identifier stratagems . . . preferable to currently sold items . . . is its bright, professional appearance, its varied identification methods, and its permanency. What also is achieved is being able to label plants and objects without delay, that is, preselecting the name before use.

These three basic components just by position can be changed from vertical to horizontal identifiers.

It is especially easy to misjudge the exact location where flower seeds, herb seeds, spring bulbs, fall bulbs, and the like were planted last season, last month, or last week. Thus, double digging often occurs. Knowing errors and duplication of digging efforts can be eliminated, forgetfulness never enters the scenario. With Jardin Gems, everything is forever accurately identified (especially garden herbs and bulbs).

Generally, the average gardener is considered more of a hobbyist than a professional landscape architect. Such versatility of the Jardin Gem is expeditious to anyone who wants, needs, decides to follow a garden layout, a plan, or pictured landscape design from a magazine/book.

It should be noted that some gardeners frequently plant at will and by whims.

Bendable wire stakes are nimble; wooden stakes break; writing/printing on soft copper metal tags or other material is time-consuming.

Appearances of wire and wooden stakes offer little in the way of endurance, beauty, and oftentimes look rather unsightly.

One important attribute of the Jardin Gem set of identifier stratagems is to know "what is where" and "where is what" and to discount relying on memory.

Here presented is a selection of novel methods to positively identify botanical plant life and objects/places/things.

The merits of this invention are the Jardin Gem identifier stratagems are made of noncorrosive material such as stainless steel, brass, copper, aluminum, et al and custom-formed. This metal tubing is nearly impossible to hand bend because of its inherent strength; it will not deteriorate; it is impervious to weather elements and lawn chemicals.

Stainless steel always presents itself as bright, strong, and durable. Indeed, being recyclable and environmentally safe are other desirable, outstanding attributes.

Additionally, a Jardin Gem can be reused unlimitedly. And, used with the three accessories generic products, there is even more identification choices. Suggested are:

(1) identifying markers;

(2) supports in various low/elevated positions;

(3) non-shifting guards for objects;

(4) holding hoses/objects in stationary position.

The user has several options as to how the identifier stratagem is to be labeled/personalized; and when subsequently implementing them, users will discover other applications . . . limited only by the imagination.

What is claimed is:

1. An assembly comprising:

a length of hollow metal tubing, and a hose;

said hollow metal tubing having two ends, one of said two ends of said hollow metal tubing being in the form of a spiral;

said length of hollow metal tubing lying in a single plane;

said length of hollow metal tubing having indicia thereon;

said hose being placed within the spiral of said one of said ends of said hollow metal tubing.

* * * * *